US007371127B2

(12) United States Patent
Wang

(10) Patent No.: US 7,371,127 B2
(45) **Date of Patent: *May 13, 2008**

(54) MODULAR JACK

(75) Inventor: Wei Che Wang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 103 days.

This patent is subject to a terminal disclaimer.

(21) Appl. No.: 11/000,750

(22) Filed: Nov. 30, 2004

(65) Prior Publication Data

US 2005/0124225 A1 Jun. 9, 2005

(30) Foreign Application Priority Data

Dec. 9, 2003 (TW) ..... 92221610 U

(51) Int. Cl.
*H01R 24/00* (2006.01)

(52) U.S. Cl. ..... 439/676

(58) Field of Classification Search ..... 439/676, 439/701, 607–610, 489–490, 540, 144, 717, 439/67, 329, 79, 660, 545
See application file for complete search history.

(56) References Cited

U.S. PATENT DOCUMENTS 4,327,958 A * 5/1982 Hughes et al. ..... 439/712
5,885,111 A * 3/1999 Yu ..... 439/676
6,095,865 A 8/2000 Wu
6,129,583 A * 10/2000 Lok ..... 439/545
6,402,563 B1 * 6/2002 Shi et al. ..... 439/676
6,733,319 B1 * 5/2004 Jørgensen ..... 439/329
6,752,662 B2 * 6/2004 Okamoto ..... 439/607
6,780,063 B2 * 8/2004 Wang et al. ..... 439/676

* cited by examiner

*Primary Examiner*—Edwin A. Leon
(74) *Attorney, Agent, or Firm*—Wei Te Chung

(57) ABSTRACT

A modular jack (100) is adapted for mounting on a printed circuit board (6) and has a housing (1) and a plurality of terminals (5) received in the housing. The housing includes a main body (4), an insert module (2), and a presser (3). The main body defines a cavity (40), a pair of grooves (41), and a pair of slots (42). The main body includes a pair of side walls (43). A pair of engaging ribs (44) outwardly project from each side wall and parallel to each other, thereby forming a mounting channel (46) for engaging the printed circuit board between the engaging ribs. As a result, the modular jack is mounted on the printed circuit board. The insert module has a pair of lead sections (21) slidably received in the grooves and a pair of guide sections (20). The presser has a pair of channels (30) slidably receiving the guide sections of the insert module and a pair of latches (33) reliably engaging with the slots of the main body. The presser further has a pair of blocks (31) abutting against bottom edges of the guide sections.

5 Claims, 5 Drawing Sheets

MODULAR JACK

BACKGROUND OF THE INVENTION

1. Field of the Invention

The present invention generally relates to an electrical connector, and more particularly to a modular jack with a simple structure and a simplified method for mounting the modular jack on a printed circuit board.

2. Description of the Prior Art

Modular jacks are widely used in telecommunication systems for facilitating connection of components thereof. As electrical devices become thinner, electrical connectors should become smaller to benefit such thin and compact electrical devices.

U.S. Pat. No. 6,095,865 discloses a related modular jack. The conventional modular jack includes an insulative housing, a terminal assembly and a shielding assembly. A pair of legs outwardly and downwardly extends from opposite sides of the shield. A circuit board defines a rectangular cutout for snugly accommodating the modular jack and a pair of mounting slits for engaging with the legs, thereby securely mounting the modular jack to the circuit board. Apparently, the assembling structure of the modular jack is relatively complicate since the first shielding forms a leg and the circuit board must define a cutout. As a result, the manufacture of the modular jack becomes relatively complex and the cost of the modular jack becomes relatively high. Furthermore, the legs are too tiny to securely fix the modular jack on the circuit board.

Hence, an improved modular jack having a simplified structure is needed to solve the above problems.

BRIEF SUMMARY OF THE INVENTION

It is an object of the present invention to provide a simple modular jack which is capable of being easily and securely assembled to a printed circuit board.

In order to attain the object above, a modular jack is adapted for mounting on a printed circuit board and has a housing and a plurality of terminals received in the housing. The housing includes a main body, an insert module, and a presser. The main body defines a cavity, a pair of grooves, and a pair of slots. The main body includes a pair of side walls, a pair of engaging ribs outwardly projecting from each side wall and parallel to each other, thereby forming a mounting channel for engaging the printed circuit board between the engaging ribs. A first elongate bump is formed on an inner surface of the top engaging rib and a second elongate bump is formed on an outside of each side wall, thereby securely fixing the printed circuit board. As a result, the modular jack is mounted on the printed circuit board. The insert module has a pair of lead sections slidably received in the grooves and a pair of guide sections. The presser has a pair of channels slidably receiving the guide sections of the insert module and a pair of latches reliably engaging with the slots of the main body. The presser further has a pair of blocks abutting against bottom edges of the guide sections.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
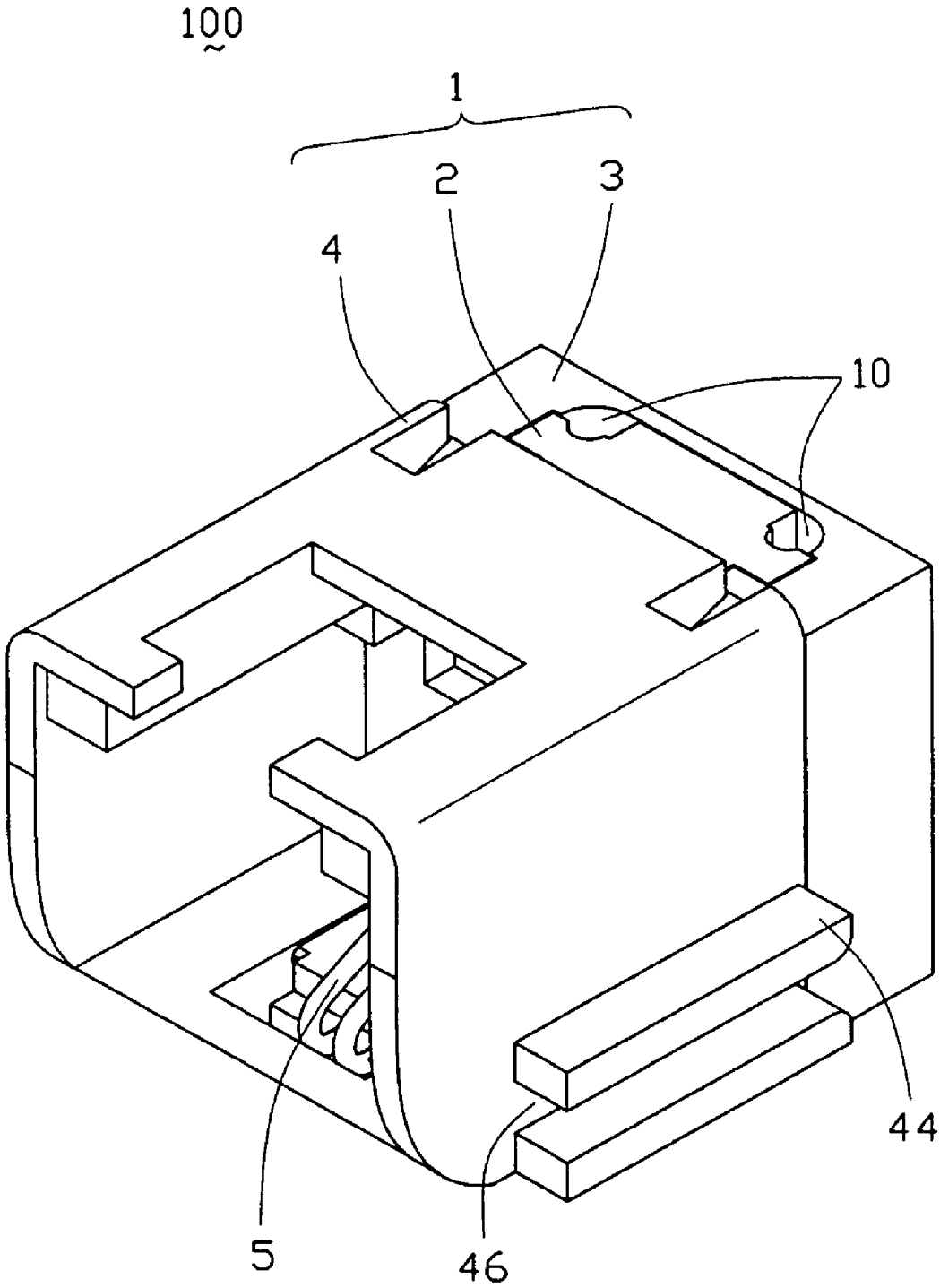
FIG. 1 is a perspective view of a modular jack of the present invention.

Reference will now be made to the drawing figures to describe the present invention in detail.

Figure 2:
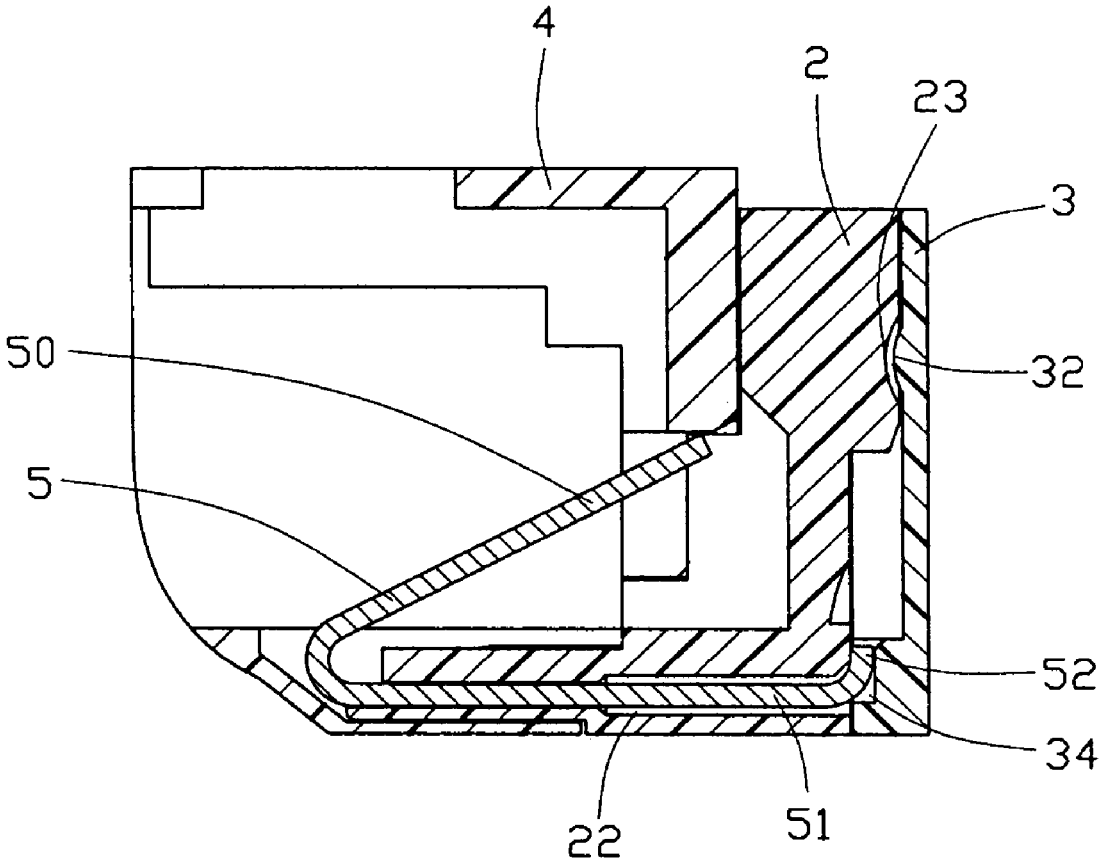
FIG. 2 is a cross-sectional view of FIG. 1.
Figure 3:
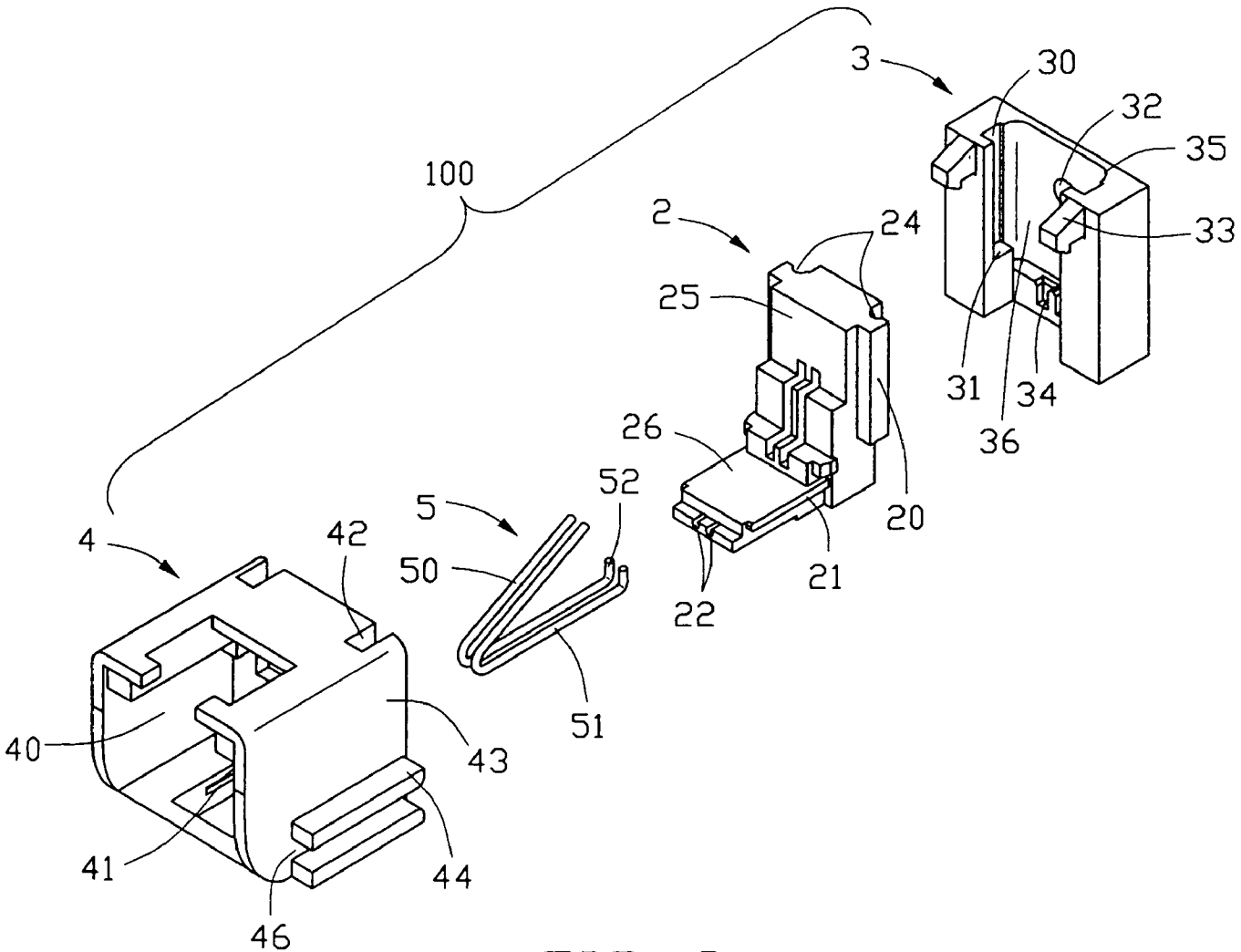
FIG. 3 is an exploded view of FIG. 1.
Figure 4:
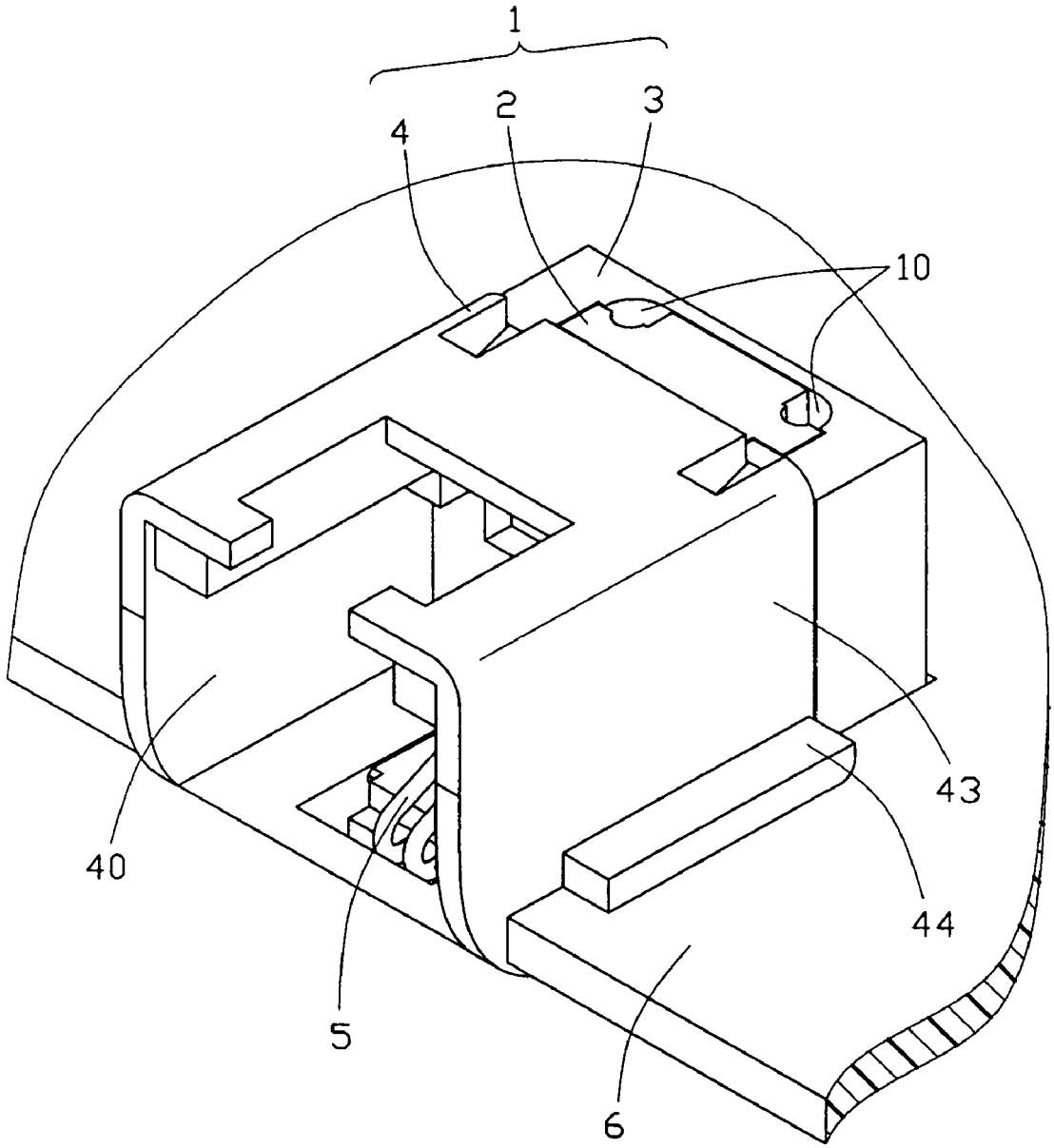
FIG. 4 is a similar view of FIG. 1, wherein the modular jack is mounted on a printed circuit board.
Figure 5:
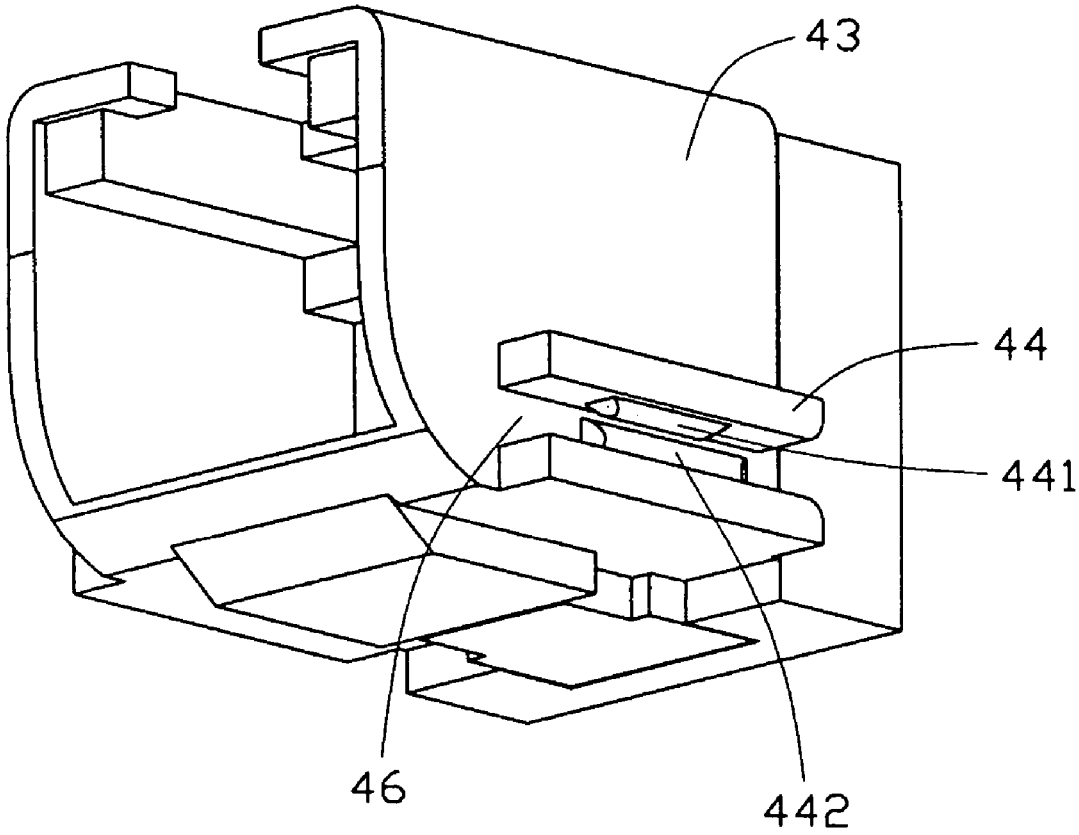
FIG. 5 is a similar view of FIG. 1, but from another perspective.

Referring to FIGS. 1-3, a modular jack 100 in accordance with a preferred embodiment of the present invention has a housing 1 including an insert module 2, a presser 3, and a main body 4, and a plurality of terminals 5 received in the insert module 2 of the housing 1.

The insert module 2 is substantially in a L-shaped configuration and has a plate section 25 and a base section 26. The base section 26 extends forwardly from a bottom edge of the plate section 25. The plate section 25 has a pair of guide sections 20 formed on lateral sides thereof and a pair of first cutouts 24 defined adjacent to corresponding guide sections 20 in a rear wall (not labeled) thereof. The pair of first cutouts 24 extends downwardly toward each other thereby forming a V-shaped configuration. The plate section 25 further defines an indentation 23 in the rear wall thereof. The base section 26 has a pair of lead sections 21 formed on lateral sides thereof and a plurality of terminal receiving passageways 22 extending therethrough.

The presser 3 is generally in a shape of a rectangular block and has a rear wall (not labeled) and two side walls (not labeled). A receiving opening (not labeled) is defined between the rear wall and the side walls and extends from a top surface to a lower surface of the presser 3. The presser 3 forms a pair of latches 33 adjacent to a top edge thereof and a pair of blocks 31 at a bottom portion of the side walls protruding into the receiving opening. The presser 3 also defines a plurality of recesses 34 at a bottom portion thereof and communicating with the receiving opening, and a pair of channels 30 in inner walls of the side walls thereof and communicating with the receiving opening. A protrusion 32 is formed on an inner wall of the rear wall of the presser 3 and protruding into the receiving opening. In addition, a pair of arc-shaped second cutouts 35 is defined in the presser 3 communicating with the receiving opening.

The main body 4 defines a cavity 40, a pair of grooves 41 in a bottom wall (not labeled) thereof, a pair of passageways 45 in a rear wall (not labeled) thereof, and a pair of slots 42 in a rear portion of a top wall (not labeled) thereof. The main body 4 includes a pair of side walls 43. A pair of engaging ribs 44 outwardly projecting from a lower portion of each side wall 43, thereby forming a mounting channel 46 for engaging with a printed circuit board 6 therebetween. A first elongate bump 441 is formed on an inner surface of the top engaging rib 44 and a second elongate bump 442 is formed on an outside of each side wall 43. The elongate bumps 441, 442 project into the mounting channel 46 to securely fix the printed circuit board 6. The printed circuit board defines a cutout for receiving the modular jack. A profile of the cutout is configured corresponding to a profile of the modular jack.

Each terminal 5 has a contacting section 50, a beam section 51 bending rearwardly and horizontally from the contacting section 50, and a connecting section 52 extending upwardly from the beam section 51.

A method for assembling the modular jack comprises the following steps:

(a) Assembling terminals 5 into corresponding terminal receiving passageways 22 of the base section 26 of the insert module 2.

(b) Electrically connecting a plurality of wires (not shown) with corresponding free ends of the connecting sections 52 of the terminals 5.

(c) Inserting the insert module 2 into the receiving opening of the presser 3 with the guide sections 20 sliding into corresponding channels 30 of the presser 3 from an upper surface toward a bottom surface of the presser 3. A bottom surface of each guide section 20 abuts against a corresponding block 31 of the presser. The first cutouts 24 and corresponding second cutouts 35 together define pilot holes 10 which receiving the wires therein. The connecting sections 52 of the terminals 5 are received in corresponding recesses 34 of the presser 3. The protrusion 32 of the presser 3 engages with the indentation 23 of the insert module 2.

(d) Assembling the leading sections 21 of the insert module 2 into corresponding grooves 41 of the main body 4. The contacting portions 50 of the terminals 5 are received in the cavity 40 of the main body 4, and the distal portion of the contacting portion 50 of the terminals 5 is deflectably received in the passageway 45.

(e) The latches 33 of the presser 3 engage with corresponding slots 42 of the main body 4 to secure the housing 1 tightly together.

(f) The printed circuit board 6 latches into the mounting channel 46 of the main body 4, thereby mounting the modular jack on the printed circuit board. At the same time, the first and second elongate bumps 441, 442 securely fix the printed circuit board 6 in the mounting channels 46.

An advantage of the present invention over the prior art results from the fact that the insert module 2 of the modular jack 100 needs not defining a plurality of slots for receiving corresponding wire which electrically connect the terminals 5 to circuit traces of a printed circuit board 6 (PCB, not shown). Furthermore, the insert module 2 and the presser 3 together define pilot holes 10 for receiving the wires to connect with the terminals 5, and the presser 3 has a pair of latches 33 respectively engage with corresponding slots 42 of the main body 4. As a result, the wires are securely fixed in the modular jack 100 without being bent too many times to prevent form escaping therefrom, thus the structure of the modular jack 100 and the assembling process are remarkably simplified.

Additionally, because the modular jack employs a pair of mounting channels 46 in the side walls 43 of the main body, the printed circuit board 6 is capable of being easily and securely inserted in the mounting channels 46. The modular jack need not be assembled additional complex elements for engaging with the printed circuit board. Thus, the structure of the modular jack 100 and the assembling process are remarkably simplified.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

a printed circuit board defining a notch in a front edge region thereof, a pair of locking edges being located by two lateral sides of said notch;

an electrical connector including an insulative housing defining a plurality of contacts therein and with two opposite channels extending along a front-to-back direction on two opposite lateral side faces, respectively; wherein positions and dimensions of said two channels are configured to comply with and snugly receive said pair of locking edges so as to allow said connector to be assembled to said notch of the printed circuit board along said front-to-back direction; wherein said housing defines a curved lower corner which is located adjacent to said front edge region.

2. An electrical connector assembly comprising:

a printed circuit board defining a notch in a front edge region thereof, a pair of locking edges being located by two lateral sides of said notch;

an electrical connector including an insulative housing defining a plurality of contacts therein and with two supporting platforms extending along a front-to-back direction on lower portions of two opposite lateral side faces, respectively;

a curved configuration being formed around a lower corner of the housing and located around a similar level with said platforms; wherein the connector is assembled into the notch of the printed circuit board with a curved lower corner located adjacent to said front edge region and with the platforms seated upon the locking edges.

3. The electrical connector assembly as claimed in claim 2, wherein none of said contacts are connected to the printed circuit board.

4. A modular jack mounting on a printed circuit board for connecting between a mating plug connector and a plurality of wires comprising:

a main body defining a cavity and a pair of side walls, a pair of mounting channels defined in the side walls for engaging with the printed circuit board;

an insert module mounted to the main body;

a plurality of terminals fixed in the insert module and extending into the cavity of the main body; and a presser securely fixed the insert module to the main body; wherein the presser defines a pair of channels vertically extending from a top surface thereof and the insert module has a pair of lead sections projecting from two lateral sides thereof, wherein the pair of lead sections are vertically extending and are received in corresponding channels of the presser; wherein mounting channel has a bump formed therein for securely receiving the printed circuit board.

5. A modular jack as claimed in claim 4, wherein the mounting channel is formed integrally with the main body.

* * * * *